US009023411B2

(12) United States Patent
Määttä et al.

(10) Patent No.: US 9,023,411 B2
(45) Date of Patent: May 5, 2015

(54) PACKAGE FOR READY-PREPARED FOODS

(75) Inventors: Päivi Määttä, Imatra (FI); Tapani Sarin, Imatra (FI); Timo Myllys, Lahti (FI); Jalliina Järvinen, Lahti (FI); Teemu Karhu, Imatra (FI)

(73) Assignee: Stora Enso Oyj, Helsinki (FI)

( * ) Notice: Subject to any disclaimer, the term of this patent is extended or adjusted under 35 U.S.C. 154(b) by 0 days.

(21) Appl. No.: 12/679,199

(22) PCT Filed: Aug. 12, 2009

(86) PCT No.: PCT/FI2009/050655

§ 371 (c)(1),
(2), (4) Date: Nov. 15, 2010

(87) PCT Pub. No.: WO2010/018304

PCT Pub. Date: Feb. 18, 2010

(65) Prior Publication Data

US 2011/0135793 A1 Jun. 9, 2011

(30) Foreign Application Priority Data

Aug. 12, 2008 (FI) ..... 20080462

(51) Int. Cl.
*B65B 25/06* (2006.01)
*B65D 77/20* (2006.01)

(52) U.S. Cl.
CPC ..... *B65D 77/2024* (2013.01)

(58) Field of Classification Search
CPC .... B29C 65/08; B29C 66/112; B29C 66/131; B29C 66/1312; B29C 66/53461; B29C 66/545; B29C 66/542; B29C 66/723; B29C 66/8322; B65B 51/22; B65B 51/225
USPC ..... 426/392, 396, 115, 523, 129, 106; 220/657, 659; D7/584–588; 206/497
See application file for complete search history.

(56) References Cited

U.S. PATENT DOCUMENTS 3,207,415 A * 9/1965 Schechter ..... 229/125.35
3,716,370 A * 2/1973 Bemiss ..... 426/403

(Continued)

FOREIGN PATENT DOCUMENTS

DE 8218388.0 U1 10/1982
DE 3940162 A1 6/1991

(Continued)

OTHER PUBLICATIONS

English Translation JP06-199361; Ito et al.; 1994; 5pgs. http://www4.ipdl.inpit.go.jp/Tokujitu/PAJdetail.ipdl?N0000=60&N0120=01&N2001=2&N3001=H06-199361.*

(Continued)

*Primary Examiner* — Steven Leff
(74) *Attorney, Agent, or Firm* — Birch, Stewart, Kolasch & Birch, LLP

(57) ABSTRACT

A package for ready-prepared foods which comprises a dish adapted to contain food, said dish containing a rim flange, and a lid, heat-sealed to the rim flange, wherein the rim flange is provided with a plurality of ridges which extend around substantially the entire periphery of the dish defining a space between said ridges, said space being divided into a plurality of transverse ridges which extend across the space forming a plurality of sealing compartments which substantially eliminate sealing leakage.

16 Claims, 2 Drawing Sheets

(56) References Cited

U.S. PATENT DOCUMENTS

| | | | | | |
|---|---|---|---|---|---|
| 4,355,755 | A | * | 10/1982 | Faller | 229/406 |
| 4,379,008 | A | * | 4/1983 | Gross et al. | 156/69 |
| 4,427,148 | A | * | 1/1984 | Seiter et al. | 229/123.1 |
| 4,605,142 | A | * | 8/1986 | Itoh et al. | 220/359.4 |
| 4,865,217 | A | * | 9/1989 | Yoshimoto | 220/266 |
| 4,924,048 | A | * | 5/1990 | Bunce et al. | 219/734 |
| 4,961,513 | A | * | 10/1990 | Gossedge et al. | 220/276 |
| D339,268 | S | * | 9/1993 | Zabner | D7/585 |
| 5,285,678 | A | * | 2/1994 | McDaniel et al. | 73/49.3 |
| 5,316,603 | A | * | 5/1994 | Akazawa et al. | 156/69 |
| 5,348,752 | A | * | 9/1994 | Gorlich | 426/129 |
| 5,888,572 | A | * | 3/1999 | Gics et al. | 426/496 |
| 6,307,192 | B1 | | 10/2001 | Ulfstedt et al. | |
| D547,616 | S | * | 7/2007 | Hayes et al. | D7/585 |
| 7,798,353 | B2 | * | 9/2010 | Blythe et al. | 220/4.24 |
| 2007/0290027 | A1 | * | 12/2007 | Maatta et al. | 229/123.1 |

FOREIGN PATENT DOCUMENTS

| | | | | | |
|---|---|---|---|---|---|
| EP | 042519 | A1 | | 4/1991 | |
| EP | 1340678 | A1 | | 9/2003 | |
| EP | 1448381 | B1 | | 8/2006 | |
| EP | 1725473 | B1 | | 11/2007 | |
| JP | 55-104673 | U | | 7/1980 | |
| JP | 4-32912 | U | | 3/1992 | |
| JP | 6-3868 | U | | 1/1994 | |
| JP | 06199361 | A | * | 7/1994 | B65D 71/08 |
| JP | 8-207175 | A | | 8/1996 | |
| JP | 9-84530 | A | | 3/1997 | |
| JP | 2004-106865 | A | | 4/2004 | |
| JP | 2007-529369 | A | | 10/2007 | |
| WO | WO 98/38954 | A2 | | 9/1998 | |

OTHER PUBLICATIONS

English translation of Japanese Office Action for Japanese Application No. 2011-522527 mailed Feb. 15, 2013.

* cited by examiner

PACKAGE FOR READY-PREPARED FOODS

BACKGOUND OF THE INVENTION

The invention relates to a package for ready-prepared foods, consisting of a dish containing the packed food in which the food has been cooked, and a lid heat-sealed to the rim flange of the dish, the rim flange being provided with two or more concentric ridges circulating the dish so that when closing the dish, a gastight seaming line is formed between the lid and the flange ridge.

Food industry produces dish-shaped consumer packages for ready-prepared foods, such as pasta and casserole dishes, the dish section of which operates as the baking dish at the preparation stage of the food. Food is put into the dish uncooked, it is cooked in it in baking temperature and finally, the dish containing the prepared cooked food is sealed with a lid. The baking dish can be made of aluminium, heat-resistant plastic or cardboard, the polymer coating of which has a sufficiently high melting temperature to withstand the food's baking temperature without melting. Packages for ready-prepared foods are marketed as frozen or most preferably deep-frozen products, which the consumer can melt and heat in an oven or microwave oven without removing the food from the dish.

A problem with baking ready-prepared foods in a dish is that greasy vapour is separated from the food when baking, the grease deposits as a thin film onto the rim flange of the dish. Likewise, hot grease and also other food ingredients may end up onto the rim flange as spatters. The rim flange working as a counter surface for the heat-sealable lid sealing the package, grease and other extra ingredients that end up on the surface of the flange upon baking cause sealing problems, because of which the lid may be left leaking and the packed food can thus perish prematurely.

The problem relating to the packing of ready-prepared foods containing fat mentioned in the patent publication EP 1 725 473 B1 has been solved so that the edges of the lid closing the dish are bent under the rim flange of the dish and heat-sealed to the lower surface of the flange. The solution is based on that, upon baking, the lower surface of the flange is substantially less exposed to grease spatters than the upper surface of the flange. There is nevertheless the drawback that the lid sealed to the lower surface of the flange is more difficult to open than if the lid were straight and sealed only to the upper surface of the flange.

Especially advantageous packages for opening are those provided with a lid that can be pulled off, in which the detachability of the heat-sealed lid has been achieved by suitable seaming polymers. Such specific polymer and their combinations are known for those skilled in the art. For example, the patent publication U.S. Pat. No. 4,605,142 discloses a plastic packing dish the rim flange of which is provided with a ridge that encircles the mouth of the dish and elevates from the surface of the flange, the lid of the dish being heat-sealed to this ridge, which is equipped with sharp tips that especially tend to facilitate the opening of the lid.

The patent publication JP 2004106865 discloses a dish sealable with a lid and intended as a food package, the rim flange of which comprises two concentric ridges circulating the dish. In addition, these concentric ridges have been connected by a transverse ridge in the dish corners, the purpose of the transverse ridge being to guide and facilitate the pulling off of the lid by pulling the flap in the said corner. Each corner of the dish is provided with a transverse ridge so that the mutual positioning of the dish and lid is not critical; the lid can be pulled off easily irrespective of in which corner the pull-off flat is located.

The patent publications U.S. Pat. No. 4,605,142 and JP2004106865, from which the ridges located in the rim flange and circulating the dish are as such known, do not especially concern the baking dish of the present invention. In accordance with the invention it has been noted, however, that the ridges elevating from the surface of the flange and circulating the ridge are especially suitable for baking dishes that contain vaporizable grease or food containing spattering ingredients upon cooking and that are closable by heat-sealing, because at the sealing stage, the lid to be pressed against the flange tends to push grease and other foreign matter aside from the top of the ridges and to reveal a clean counter surface, to which the lid can tightly be sealed. In other words, the ridges are self-cleaning at the sealing stage. This effect can still be intensified, if the cross-section profile of the ridges is tapering or sharp-pointed. For example, a grease film settled onto the flange surfaces breaks upon sealing at the tip of the ridge, making possible the generation of an intact sealing line along the ridge.

Although the ridges improve the sealability of the dish lid and the pulling off of the sealed lid, and reduce the risk of leakages in baking packages, there is however a certain risk of leakages, due to the previously mentioned grease and other impurities, but also to possible small manufacturing flaws and other irregularities in the narrow ridges. The risk of leakages becomes naturally smaller, if the flange has several concentric ridges circulating the dish instead of one; the package is a leaking package only if all concentric ridges are leaking.

Nevertheless, multiplying the number of concentric ridges is as such an ineffective solution for diminishing leakages and it further requires a wide area of the rim flange. The problem solving according to this invention comprises a significant reduction in the probability of leakages without it being necessary to increase the area required by the ridges or the area of the rim flange for arranging the ridges onto it. It is characteristic of the invention that the space between two concentric ridges of the rim flange has been divided into at least five compartments by trans-verse ridges to minimise the possibility of sealing leakages.

SUMMARY OF THE INVENTION

The essential idea of the invention is that as a sealing formed by merely two concentric ridges is leaking every time both ridges leak from any place, in the invention leakage requires that both leakage points fall on the area of the same compartment separated by transverse ridges. If an inner and outer ridge leak into different compartments, the sealing line formed by ridges is still tight, let it be that it transfers through the transverse ridges from the inner ridge to the outer and vice versa for bypassing the compartments.

According to an advantageous embodiment of the invention the rim flange has three concentric ridges circulating the dish and, respectively, two spaces between the ridges, both having been divided into compartments by transverse ridges. Such a package leaks only in cases in which all three concentric ridges leak into compartments, which are located adjacent to each other in the transverse direction. The transverse ridges in the said spaces between the concentric ridges can be located side by side, or they can be located in a stepped manner in relation to each other in the said spaces. The transverse ridges that divide the space between two concentric ridges into compartments can be located at regular intervals on the circumference of the dish. Even though the minimum number of transverse ridges is five according to the invention, it is obvious that the risk of leakages is the smaller the more densely the space between concentric ridges has been divided into compartments, i.e. the bigger the number of transverse ridges is. The only restriction is that the compartments must not become so small that they could not receive the grease pushing into their direction from the ridge in the sealing. Thus the number of transverse ridges is preferably at least 10 and in a typical portion package for ready-prepared food preferably between 20 and 200.

Portion packages for ready-prepared foods are most typically rectangular when seen from above, the dish section often expanding slightly upwards. In a lid to be heat-sealed into such a dish the pull-off flap is located in one of the package's four corners. At least part of the transverse ridges is then located on the straight sides of the package, separated from the package's corners and the lid's pull-off flap. These transverse ridges only serve to provide tightness to the package of the invention, and they are not significant for the pulling off of the lid according to the publication JP2004106865.

Alternatively the package for ready-prepared foods can be shaped also circular or elliptical when seen from the top so that the transverse ridges have been divided along the circumference of the dish or onto the elliptically curving sides, preferably approximately at regular intervals. According to the invention at least the main part of the transverse ridges are then located elsewhere than in the points into which the pull-off flap of the lid is intended to be positioned.

Materials used for the packages for ready-prepared foods can vary according to the invention, but a package can be mentioned as an advantageous embodiment, in which the dish section is made of polymer-coated cardboard with the exception of the rim flange, which is made entirely of injection-moulded plastic, and the inner surface of the lid is made of polymer-coated paper or cardboard. The heat seal closing the package is formed by the polymer materials of the flange and lid, the materials being chosen so that the lid will come off by peeling off from its joint sealing by pulling the flap.

BRIEF DESCRIPTION OF THE DRAWINGS

The invention will next be explained in more detail by means of examples, referring to the attached drawings, in which.

DETAILED DESCRIPTION OF THE INVENTION

Figure 1:
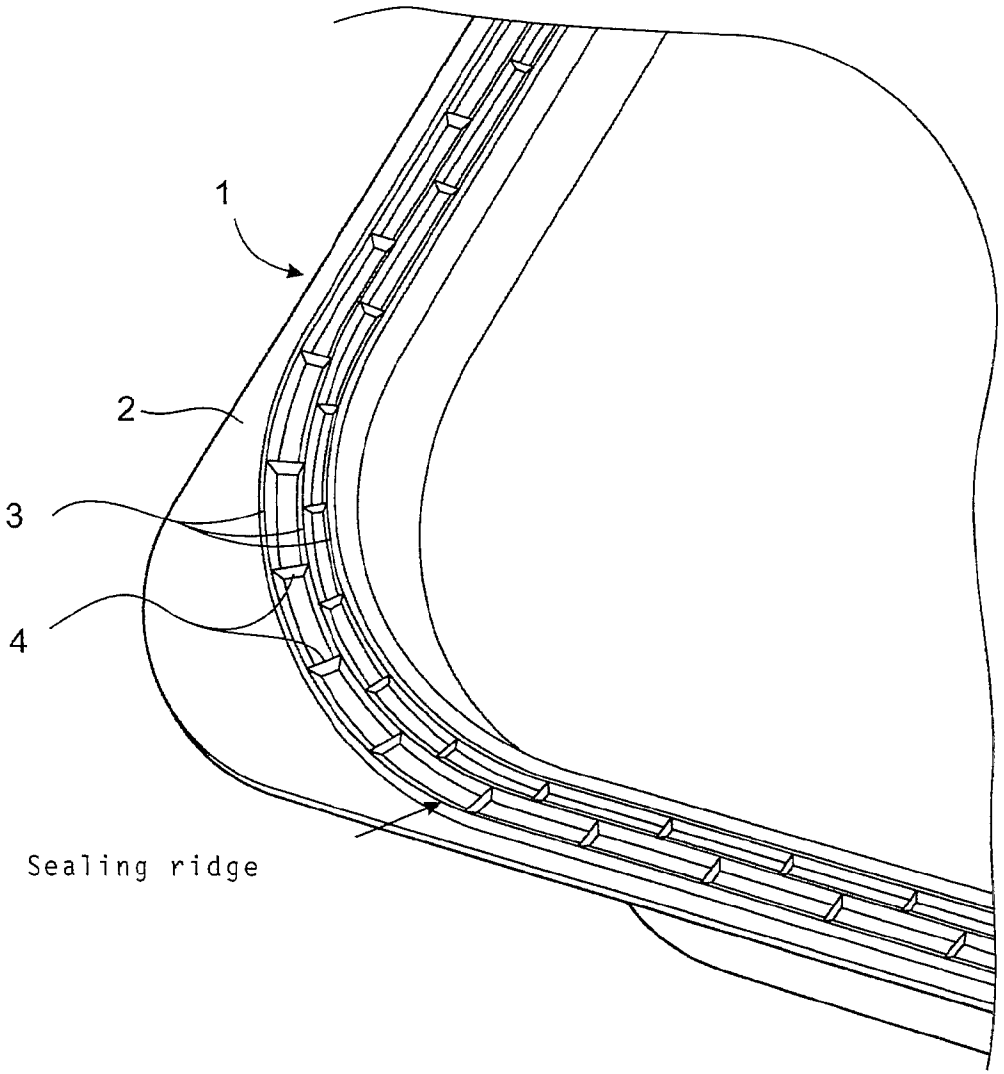
FIG. 1 illustrates a corner of the dish section of a package for ready-prepared foods according to the invention with sealing ridges for the rim flange.
Figure 2:
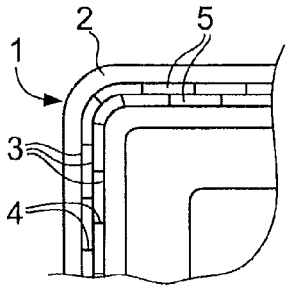
FIG. 2 is a top view of a corner of the dish according to FIG. 1.
Figure 4:
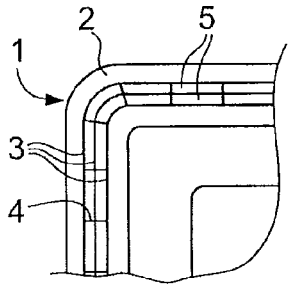
FIG. 4 is a top view of a corner of a dish according to a third embodiment of the invention.

FIGS. 1 and 2 illustrate a corner of the dish section 1 of a package for ready-prepared foods according to the invention, provided with rim flanges 2 and sealing ridges 3 elevating from the surface of the flange and circulating the dish. The flange 2 has three concentric longitudinal ridges 3 circulating the dish and trans-verse ridges 4 connecting these and located at regular intervals. The transverse ridges 4 divide the space between the concentric ridges 3 into compartments 5 that close as the lid of the package is sealed. As can be seen from FIGS. 1 and 2, the transverse ridges 4 are situated in a stepped manner in relation to each other in the spaces of different longitudinal ridges. Alternatively, the transverse ridges 4 in the embodiment according to FIG. 4 are located in the spaces of different longitudinal ridges 3 adjacent to each other, thus forming uniform ridges across the spaces restricted by the longitudinal ridges (3).

Figure 3:
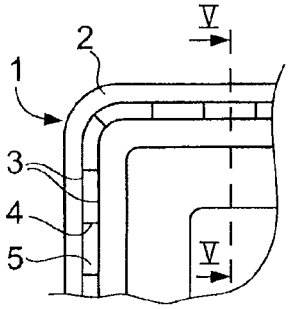
FIG. 3 is a top view of a corner of a dish according to a second embodiment of the invention.

In FIG. 3 there is shown a simpler embodiment of the invention, in which the rim flange 2 is provided with two concentric longitudinal ridges 3 circulating the dish 1 and with transverse ridges 4 connecting these and located at regular intervals.

Figure 6:
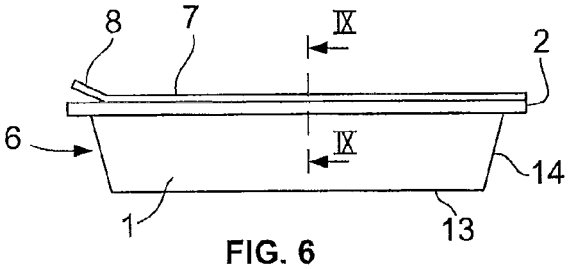
FIG. 6 is a side view of a rectangular package of the invention for ready-prepared foods with a lid.

The dishes according to FIGS. 1-4 can be part of the package 6 for ready-prepared foods in FIG. 6, which consists of a rectangular dish 1 and lid 7, which is heat-sealed onto its rim flange 2 and which closes the package in a gastight manner. The lid 7 is provided with a pull-off flap 8 in the corner of the package 6 so that the lid can be removed from the dish for opening the package.

Figure 5:
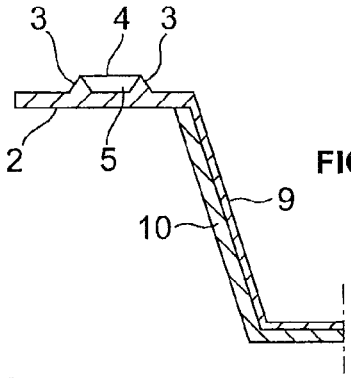
FIG. 5 illustrates the dish's side wall and rim flange as a section V-V of FIG. 3.
Figure 9:
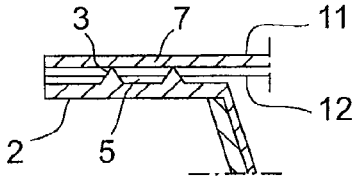
FIG. 9 illustrates the rim flange of the dish and the lid sealed into it as section IX-IX of FIG. 6.

The structure of the rim flange 2 of the dish 1 and the shape of the sealing ridges 3 can be seen more closely in the cross-section of the side wall of the dish 1 in FIG. 5. The dish 1 consists internally of polymer-coated 9 cardboard 10, and the rim flange 2 circulating the mouth of the dish has been formed to it by injection-moulding. Concentric longitudinal ridges 3 with a triangular cross-section elevate from the surface of the rim flange 2, restricting between them the spare divided into compartments 5 by the transverse ridges 4, which space is closed as the package lid 7 is sealed to the rim flange 2 in accordance with FIG. 9.

The cross-section profile of the longitudinal sealing ridges 3 can vary in scope of the invention, but most preferably the profile tapers upwards towards the top of the ridge. In a triangular profile the angle of point is most suitably 45-120°. Alternatively the profile shape can be e.g. a trapezoid. The cross-section profile of the transverse ridges 4 is preferably identical with that of the longitudinal ridges 3.

A suitable material for the injection-moulded rim flange 2 is especially polyethylene terephtalate (PET) or some other polymer with high melting temperature and withstanding the baking temperatures. Also the polymer coating 9 of the base cardboard 10 of the dish 1 can be made of PET. Alternatively the polymer 9 can be silicon containing, partly inorganic and partly organic hybrid polymer as disclosed in the patent publication U.S. Pat. No. 6,307,192 B1. The lid 7 can be made of paper or thin flexible cardboard 11, and its internal polymer coating 12 can consist of e.g. a composite of ethylene methylene acrylate copolymer (EMA), ethylene vinyl acetate copolymer (EVA) and wax, as disclosed in the publication EP 1 448 381 B1. The sealing polymer in question provides together with the ridges 3, 4 of PET a gastight closure, which is easily removable when pulling off the lid.

The packages for ready-prepared foods according to the invention and illustrated in the drawings are baking packages, in which food has been placed into the dish 1, baked in it, and after that the dish has been closed by heat sealing the lid 7. In heat sealing the internal polymer coating 12 of the lid forms a vapour and oxygen impermeable closure together with the ridges 3, 4. Grease vapour is released from the food during cooking, and this will deposit as a film onto the surface of the rim flange 2. In addition grease and other food ingredients can spatter to the rim flange 2 during baking. The grease layer on the rim flange 2 impedes the heat sealing so that the closure of the lid may be left leaking. However, in the invention this has been prevented so that upon sealing the lid 7 pushes the grease aside at the place of the ridges 3, 4, especially the pointed tops of the ridges so that tight sealing lines are formed between the ridges 3, 4 and the polymer coating 12 inside the lid. The space divided into compartments 5 between the ridges operates then as a collector of grease and other matters transferring aside from the ridges. In addition, it has been achieved with the transverse ridge 4 that even though the sealing lines at some points of the longitudinal ridges 3 were left leaking, a tight sealing line twisting from one longitudinal ridge 3 to the other through the transverse ridges 4 can in high probability still be maintained in the package. Thus the risk of sealing leakages has been substantially diminished with the invention.

Figure 8:
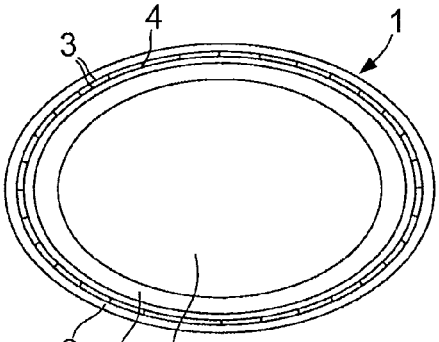
FIG. 8 is a top view of the dish section of an elliptical package of the invention for ready-prepared foods.
Figure 7:
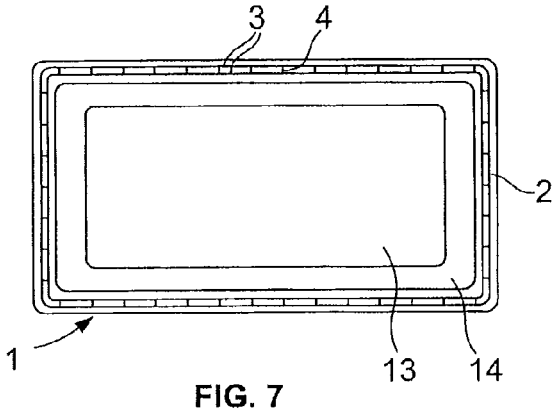
FIG. 7 is a top view of the dish section of the package of FIG. 6 without the lid.

Reference is still made to FIGS. 6-8 concerning the general shape of the package (6). The shape of the package can thus be rectangular in accordance with FIGS. 6 and 7 so that the dish 1 has an even rectangular bottom 13, slightly outwards inclined side walls 13 and a rectangular rim flange 2. The pull-off flap 8 of the lid 7 sealed to the flange 2 is located in one of the corners in the package. An elliptical package 6 has been shown as an alternative in FIG. 8, this package also comprising slightly inclined side walls 14. The pull-off flap 8 is located at either end of the ellipse. The shape of the package can also be circular.

It is obvious for one skilled in the art that the embodiments of the invention are not restricted to the examples disclosed above, but they can vary within the scope of the following patent claims.

The invention claimed is:

1. A packaging container for ready-prepared foods, comprising a container adapted to contain packed food, said container provided with a polymeric rim flange, and a lid heat-sealed to the rim flange, the rim flange being provided with three concentric ridges encompassing the perimeter of the container which define two spaces between the ridges, so that when closing the lid on the container, a gastight sealing line is formed between the lid and the rim flange, wherein the space between the concentric ridges of the rim flange is divided by transverse ridges into at least five separate, sealed compartments which are defined by the concentric ridges, the transverse ridges and the lid, and wherein the profile of the ridges is tapered upward to a pointed top to push grease aside as the lid is sealed to the dish.

2. The packaging container for ready-prepared foods according to claim 1, wherein the transverse ridges in the said spaces are located adjacent to each other.

3. The packaging container for ready-prepared foods according to claim 1, wherein the transverse ridges in the said spaces are located in a stepped relationship relative to each other.

4. The packaging container for ready-prepared foods according to claim 1, wherein the transverse ridges dividing the space into said separate, sealed compartments are located at regular intervals within said space.

5. The packaging container for ready-prepared foods according to claim 1, wherein the container has a rectangular configuration.

6. The packaging container for ready-prepared foods according to claim 5, wherein at least part of the transverse ridges are located on the four straight sides of the dish.

7. The packaging container for ready-prepared foods according to claim 1, wherein the container has a circular or elliptical configuration.

8. The packaging container for ready-prepared foods according to claim 7, wherein the transverse ridges are provided on the circular circumference or on the elliptically curved sides of the container.

9. The packaging container for ready-prepared foods according to claims claim 1, wherein the lid of the container has a pull-off flap and the transverse ridges are located on straight or curved sides of the container outside the point where the flap is located.

10. The packaging container for ready-prepared foods according to claim 9, wherein the packaging container has a rectangular configuration and the pull-off flap is provided in one corner of the rectangular configured packaging container and the transverse ridges are located on straight sides of the package outside the corners of the packaging container.

11. The packaging container for ready-prepared foods according to claim 1, wherein the space between the three ridges is divided into at least ten, separate, sealed compartments by the transverse ridges.

12. The packaging container for ready-prepared foods according to claim 1, wherein the packaging container is made of a polymer-coated cardboard whereby the rim flange of the packaging container comprises an injection-moulded plastic and the heat-seal closing the packaging container is formed between the ridges extending above the surface of the rim flange and the polymer-coating of the interior of the lid that can be pulled off.

13. The packaging container for ready-prepared foods according to claim 1, wherein the space between the three ridges is divided into 20 to 200 separate, sealed compartments by the transverse ridges.

14. A packaging container for ready-prepared foods which comprises a container adapted to contain food, said container provided with a rim flange, and a lid, heat-sealed to the rim flange, wherein the rim flange is provided with three concentric annular ridges which extend around substantially the entire periphery of the packaging container, defining a space between said concentric ridges, said space being divided, by a plurality of transverse ridges which extend across the space, into a plurality of separate, sealed compartments which are defined by the concentric annular ridges, the transverse ridges and the lid.

15. The packaging container of claim 14, wherein the top of the annular ridges and the top of the transverse ridges form a sealing line with the lid, defining the plurality of said sealed compartments.

16. The packaging container of claim 15, wherein the top edge of the annular ridges and the top edge of the transverse ridges are in the same plane.

* * * * *